United States Patent [19]

Hoshiai et al.

[11] Patent Number: 4,715,257

[45] Date of Patent: Dec. 29, 1987

[54] WAVEFORM GENERATING DEVICE FOR ELECTRONIC MUSICAL INSTRUMENTS

[75] Inventors: Atsushi Hoshiai; Hiroyuki Endo, both of Osaka, Japan

[73] Assignee: Roland Corp., Osaka, Japan

[21] Appl. No.: 889,472

[22] Filed: Jul. 25, 1986

[30] Foreign Application Priority Data

Nov. 14, 1985 [JP] Japan ..... 60-256142

[51] Int. Cl.[4] ..... G10H 7/00

[52] U.S. Cl. ..... 84/1.01; 84/1.28; 364/723

[58] Field of Search ..... 84/1.01, 1.28; 381/51, 381/61; 364/718, 723, 724, 728

[56] References Cited

U.S. PATENT DOCUMENTS

| | | | |
|---|---|---|---|
| 4,205,575 | 6/1980 | Hoskinson et al. | 84/1.01 |
| 4,246,823 | 1/1981 | Wachi et al. | 84/1.01 X |
| 4,536,853 | 8/1985 | Kawamoto et al. | 84/1.01 X |
| 4,602,545 | 7/1986 | Starkey | 84/1.01 |
| 4,612,838 | 9/1986 | Nagashima et al. | 84/1.01 |
| 4,633,749 | 1/1987 | Fujimori et al. | 84/1.01 |
| 4,635,520 | 1/1987 | Mitsumi | 84/1.01 X |

*Primary Examiner*—S. J. Witkowski

*Attorney, Agent, or Firm*—Morris Fidelman; Franklin D. Wolffe

[57] ABSTRACT

An improved waveform generator used in an electronic musical equipment for reproducing musical sounds stored therein, in which the waveform of each musical sound is stored in a memory as a sequence of amplitudes sampled at specific sampling points on the waveform and reproduced therefrom by interpolating arithmetically any point between these sampling points.

2 Claims, 14 Drawing Figures

WAVEFORM GENERATING DEVICE FOR ELECTRONIC MUSICAL INSTRUMENTS

This invention relates to a waveform generating device used in electronic musical instruments for reading waveform sample values stored in a memory to produce musical sounds and, especially, to such device which stores differences of respective sample values in the memory, but not the sample values of waveform themselves.

BACKGROUND OF THE INVENTION

Such a technique as to previously sample a musical sound at a predetermined sampling frequency, store the resultant sample values in a memory and read out the sample values to reconstruct the musical sound has been known in the art.

In such technique, a so-called fixed sampling system is known as a system for controlling pitch (frequency) of generated musical sound. In this system, with reading rate kept unchanged, the sample values are read out of the memory as being thinned out by a suitable number and the pitch is changed by changing this thinning number.

This fixed sampling system needs a number of sample values for producing such sounds as demanded in musical instruments, which differ slightly in pitch, and, therefore, requires a corresponding capacity of memory. In order to reduce this required memory capacity, the opened Japanese patent specification No. 53-84708 has proposed to reduce the number of sample values and, when an amplitude between adjoining sample values is requested, to obtain it by interpolation. As the method for this interpolation, polynomial interpolation, Lagrange's interpolation and interpolation with filter are known (c.f., for example, "Digital Filter", (1977) Prentice Hall Inc.). The interpolation with filter has been applied to this invention. The principle of this interpolation will not be described further since it is not the object of this application. This principle teaches that the amplitude of waveform at any time point can be obtained by convolution computation if an impulse response waveform of a filter as shown in FIG. 4 as the interpolation filter is stored in terms of amplitude values $f_0, f_1, f_2, \ldots$ sampled at a frequency higher by a factor of m (m=4 in the illustrative embodiment) than the sampling frequency of the waveform.

For example, when a waveform as shown in FIG. 5 has amplitude values $Y_0, Y_1, Y_2, \ldots$ and it is requested to interpolate an amplitude $P_4$ as shown in FIG. 5, $P_4$ can be obtained as follows.

$$P_4 = Y_0f_1 + Y_1f_5 + Y_2f_9 + Y_3f_{13} + Y_4f_{17} + Y_5f_{21} + Y_6f_{25} + Y_7f_{29} \quad (1)$$

Similarly, amplitude $P_5$ can be obtained as follows.

$$P_5 = Y_1f_2 + Y_2f_6 + Y_3f_{10} + Y_4f_{14} + Y_5f_{18} + Y_6f_{22} + Y_7f_{26} + Y_8f_{30}$$

Amplitude $P_6$ can be obtained as follows.

$$P_6 = Y_2f_3 + Y_3f_7 + Y_4f_{11} + Y_5f_{15} + Y_6f_{19} + Y_7f_{23} + Y_8f_{27} + Y_9f_{31}$$

The amplitudes at the other points between the sample values can be interpolated similarly.

It is assumed here, for simplicity of description, that the respective sample values of the impulse response of lowpass filter are sampled at a frequency at most four times the sampling frequency of the waveform as shown in FIG. 5. Therefore, interpolation can be effected at only three points between the sampling points. In practice however, highly accurate interpolation is effected by increasing the sampling frequency. Although it is ideal to obtain the respective sample values of the lowpass filter by sampling the infinite impulse response from time $-\infty$ to $+\infty$, those which are sampled by limiting a finite region with a suitable window such as humming window as shown in FIG. 4 can be used sufficiently.

FIG. 8 is a block diagram of a device for effecting interpolation based upon the abovementioned principle, in which 1 denotes a waveform memory which stores the sample values $Y_0, Y_1, Y_2, \ldots$ shown in FIG. 5 at its addresses "000", "001", "010", . . . (" " indicates a binary notation).

2 denotes an interpolation table which stores sample values $t_0$ to $t_{15}$ at its addresses "0000" to "1111", respectively, as shown in FIG. 9. While the interpolation table 2 is originally arranged to store $f_0$ to $f_{32}$ as shown in FIG. 4, it is considered to store only $f_0$ to $f_{16}$ at addresses "0000" to "10000" and to turn back the addresses when $f_{17}$ to $f_{32}$ are needed, since they are symmetric about $f_{16}$ as the center. While two's complement of each address may be taken for turning back the addresses, it is necessary for this purpose to invert the respective bits of each address and to add "1" thereto. As shown in FIG. 9, therefore, it stores the sample values $t_0$ to $t_{16}$ which are shifted by a half bit each from the sample values $f_0$ to $f_{16}$, respectively. In this case, it is enough to invert each bit of address for turning back the addresses. Although such half bit shift results in reading of $t_0, t_4, t_8, \ldots$, for example, which shift by a half bit from $f_0, f_4, f_8, \ldots$ which are the sample values needed originally, the interpolated amplitude will not deform since the shift is fixed constantly.

4 denotes an address generator for generating an address composed of an integer part of three bits and a decimal part of two bits.

5 denotes a counter for sequentially counting from "000" to "111". An adder adds each count to the integer part of the output of address generator 4 to provide a sum to the waveform memory 1 for use to read the sample values of waveform $Y_0, Y_1, \ldots$. Each count and the decimal part of the output of address generator 4 are supplied through an invertor 6 to interpolation table 2 for use to read the sample values of impulse response $t_0, t_1, \ldots$. The invertor serves to provide interpolation table 2 with inverted decimal part of the address and non-inverted bits of the count excepting the most significant bit (MSB) when MSB is "0" and with non-inverted decimal part of the address and inverted bits of the count excepting MSB when MSB is "1". The invertor 6 may be composed, for example, of four exclusive OR gates.

The sample values read out of waveform memory 1 and interplation table 2 are multiplied by a multiplier 7 and the resultant product is accumulated in an addition register 8.

Now, the description will be made on the operation of this device. Assume now that the address generator 4 is sequentially generating addresses at an increment of "00011", such as "00000", "00011", "00110", . . . and the current output address is "00011". The counter 5 provides first an output count "000" which is added by an adder 10 to the integer part "000" of the output address of address generator 4 and the resultant sum "00000" is applied to waveform memory 1 to read therefrom a sample value $Y_0$ as shown in FIG. 5. As MSB of the count outut of counter 5 is "0", the decimal part "11" of the address is inverted by invertor 6 and applied to interpolation table 2 as the least significant bits (LSBs), and the bits "00" other than MSB of the count of counter 5 is unchanged and applied to interpolation table 2 as MSBs. Thus, $t_0$ is read out from interpolation table 2 and multiplied by $Y_0$ in multiplier 8 and the resultant product is supplied to addition register 8.

When the count output of counter 5 is incremented by one, the address applied to waveform memory 1 becomes "00100" and the sample value $Y_1$ is read out therefrom as shown in FIG. 5. On the other hand, the address applied to interpolation table 2 becomes "0100" and $t_4$ is read out therefrom as shown in FIG. 9 and multiplied by $Y_1$ in multiplier 7. The resulting product is accumulated by the addition register 8.

Similar operation is repeated every time the count output of counter 5 is incremented by one, before MSB of the count output becomes "1", that is, the count output becomes "100". During the operation, $Y_2$, $Y_3$, $t_8$ and $t_{12}$ are read out and products $Y_2t_8$ and $Y_3t_{12}$ are calculated and accumulated in addition register 8.

When the count output of counter 5 becomes "100", $Y_4$ is read out from the address "10000" of waveform memory 1 in the same fashion as above. However, since MSB is "1", the decimal part "11" of the address is applied as it is as LSBs of interpolation table 2, and the bits of count "00" other than MSB are inverted and applied as MSBs of interpolation table 2. Consequently, $t_{15}$ is read out from address "1111" of interpolation table 2 as shown in FIG. 9. In the same fashion, thereafter, until the count output of counter 5 becomes "111", $t_{11}$, $t_7$ and $t_3$ are read out from interpolation table 2, $Y_5$, $Y_6$ and $Y_7$ are read out from waveform memory 1, and products $Y_5t_{11}$, $Y_6t_7$ and $Y_7t_3$ are calculated by multiplier 7 and accumulated in addition register 8. Consequently, the content of addition register 8 becomes:

$$Y_0t_0+Y_1t_4+Y_2t_8+Y_3T_{12}+Y_4t_{15}+Y_5t_{11}+Y_6t_7+Y_7t_3$$

and, thus, the amplitude $P_4$ shown in FIG. 5 is interpolated.

In such prior art, the content of waveform memory 1 is consisting of waveform sample values $Y_0$, $Y_1$, $Y_2$, . . . . In order to save the capacity of memory, it may be recommendable to store the differences between the successive sample values of waveform rather than the sample values themselves. However, when the differences are stored, it is necessary to recover therefrom the original sample values and execute their convolution operation with respective sample values of impulse response, and this requires a complicated circuit configuration.

More particularly, when the differences $d_0$, $d_1$, . . . $d_7$ as shown in FIG. 5 are stored for saving the capacity of memory, the equation (1) representing the amplitude $P_4$ is rewritten as follows.

$$P_4 = Y_0f_1 + (Y_0 + d_1)f_5 + (Y_0 + d_1 + d_2)f_9 + (Y_0 + d_1 + d_2 + d_3)f_{13} + (Y_0 + d_1 + d_2 + \tag{2}$$

-continued $$d_3 + d_4)f_{17} + (Y_0 + d_1 + d_2 + d_3 + d_4 + d_5)f_{21} + (Y_0 + d_1 + d_2 + d_3 + d_4 + d_5 + d_6)f_{25} + (Y_0 + d_1 + d_2 + d_3 + d_4 + d_5 + d_6 + d_7)f_{29}$$

In order to obtain interpolation using this equation, it is necessary to accumulate the differences to calculate the respective sample values and, therefore, to use a complicated circuit.

SUMMARY OF INVENTION

This invention has solved the problem of complication of circuit as follows.

The equation (2) can be rewritten as $$P_4 = (f_1 + f_5 + f_9 + f_{13} + f_{17} + f_{21} + f_{25} + f_{29})Y_0 + (f_5 + f_9 + f_{13} + f_{17} + f_{21} + f_{25} + f_{29})d_1 + (f_9 + f_{13} + f_{17} + f_{21} + f_{25} + f_{29})d_2 + (f_{13} + f_{17} + f_{21} + f_{25} + f_{29})d_3 + (f_{17} + f_{21} + f_{25} + f_{29})d_4 + (f_{21} + f_{25} + f_{29})d_5 + (f_{25} + f_{29})d_6 + f_{29}d_7 \tag{3}$$

However, $$f_1+f_5+f_9+f_{13}+f_{17}+f_{21}+f_{25}+f_{29}=1$$

Therefore, the equation (3) can be rewritten as $$P_4=Y_0+g_5d_1+g_9d_2+g_{13}d_3+g_{17}d_4+g_{21}d_5+g_{25}d_6+g_{29}d_7 \tag{4}$$

where $g_5=f_5+f_9+f_{13}+f_{17}+f_{21}+f_{25}+f_{29}$,
$g_9=f_9+f_{13}+f_{17}+f_{21}+f_{25}+f_{29}$,
$g_{13}=f_{13}+f_{17}+f_{21}+f_{25}+f_{29}$,
$g_{17}=f_{17}+f_{21}+f_{25}+f_{29}$,
$g_{21}=f_{21}+f_{25}+f_{29}$,
$g_{25}=f_{25}+f_{29}$, and
$g_{29}=f_{29}$.

Accordingly, if $g_5$, $g_9$, . . . $g_{29}$ are stored in interpolation table 2 and $d_0$, $d_1$, $d_2$, . . . $d_7$ are stored in waveform memory 1, the value of $P_4$ can be obtained by calculating products $g_5d_1$, $g_9d_2$, . . . $g_{29}d_7$ from these stored values and accumulating them together with $Y_0$. It will be self-evident that the arithmetic circuit for handling the equation (4) is substantially simpler than the prior art circuit for handling the equation (2).

The above description was made on the convolution operation at point $P_4$. When addresses are given to the respective sample values and amplitudes to be interpolated sequentially from "00000" wherein the three most significant bits form the integer part and the two least significant bits form the decimal part, as shown in FIG. 5, $P_4$ is a point having "11" as the decimal part of its address. Other points ($P_8$ etc.) having "11" as the decimal part of their addresses can be interpolated with $g_5$, $g_9$, . . . $g_{29}$. Similarly, those points ($P_6$ etc.) having "01" as the decimal part of their addresses can be interpolated using $g_7(f_7+f_{11}+ \ldots +f_{31})$, $g_{11}(f_{11}+ \ldots +f_{31})$, $g_{15}(f_{15}+ \ldots +f_{31})$, $g_{19}(f_{19}+ \ldots +f_{31})$, $g_{23}(f_{23}+ \ldots +f_{31})$, $g_{27}(f_{27}+f_{31})$ and $g_{31}(f_{31})$. Those points ($P_1$, $P_5$, . . . ) having "10" as the decimal part of their addresses can be interpolated using $g_6$, $g_{10}$, $g_{14}$, $g_{18}$, $g_{22}$, $g_{26}$ and $g_{30}$. The values of $g_5$ to $g_{31}$ (hereinunder referred to as "integrated values of impulse response") are generalized by an equation $$g_{i+mj} = \sum_{k=j}^{n-1} f_{i+mk}$$

where i=0, 1, 2, . . . m−1 and J=1, 2, . . . n−1, and are shown by solid lines in FIG. 3. These values of $g_5$ to $g_{31}$ are stored in an interpolation memory, since interpolation can be applied to the amplitudes at tetrasectional points in each interval been the adjoining sample values using these values.

While the above description was made on the tetrasectional interpolation points between the adjoining sample points for simplification, it is necessary to interpolate with increased points (e.g. 64 points) between the sample points in order to improve accuracy of tone and pitch of the musical sound.

Now, the invention will be described in more detail below in conjunction with a preferred embodiment with reference to the accompanying drawings.

In the drawings:

FIG. 1 is a block diagram representing an embodiment of waveform generating device according to this invention;

FIGS. 2(*a*)–(*e*) is a diagram representing signal waveforms appearing at specific points of the embodiment;

FIG. 7(*b*) is a diagram representing a frequency characteristic of this low-pass filter;

DESCRIPTION OF PREFERRED EMBODIMENT

Figure 1:
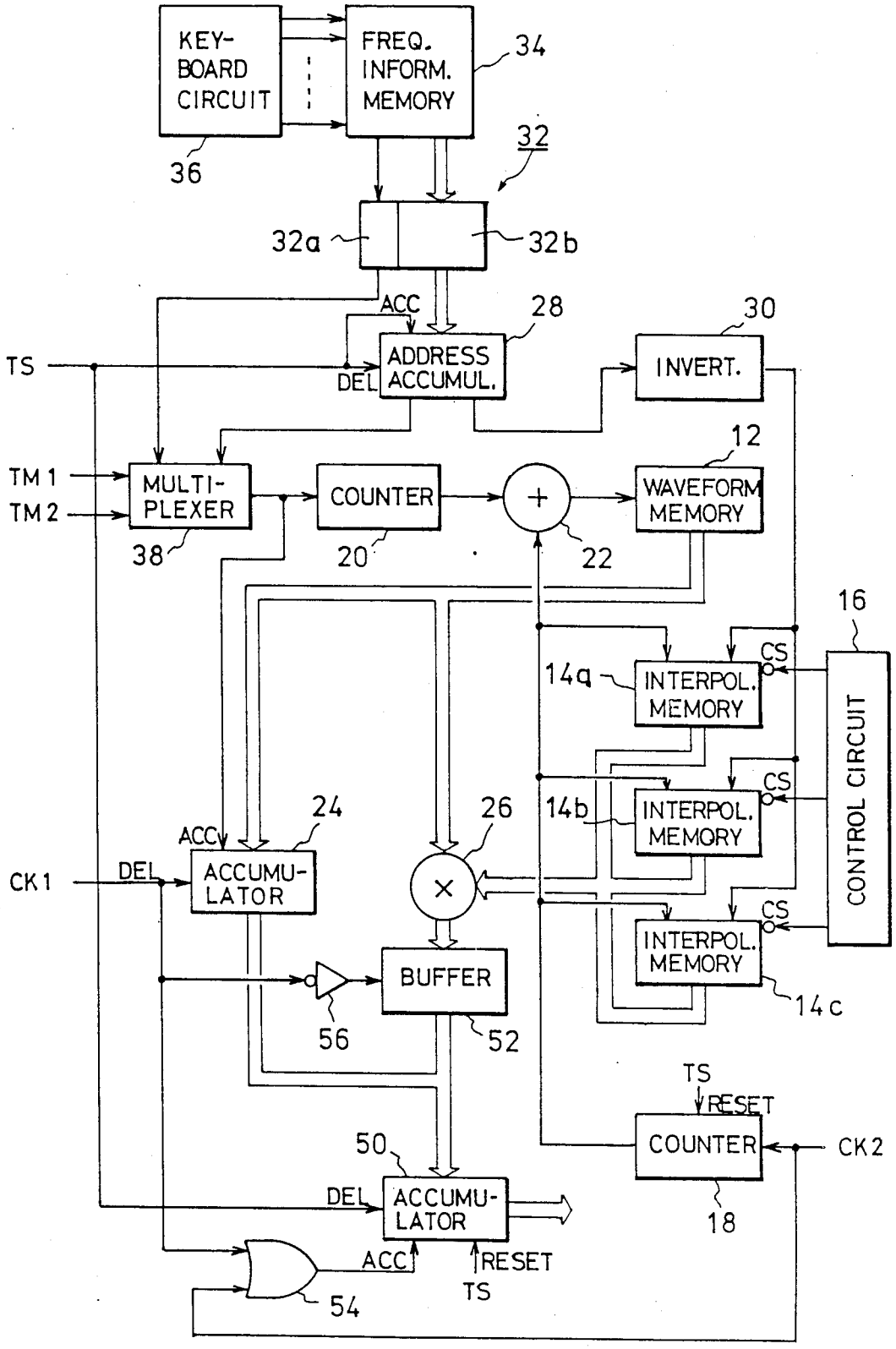
Figure 5:
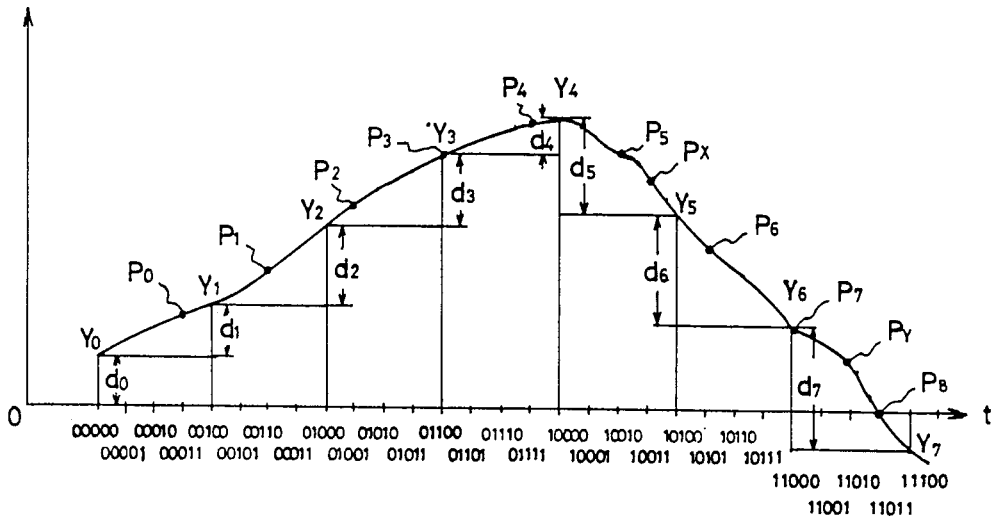
FIG. 5 is a diagram representing a waveform of musical sound and its sample values used in the embodiment.

Referring to FIG. 1, an embodiment of this invention is shown to have a waveform memory 12. The memory 12 stores the sample differences $d_0$, $d_1$, $d_2$, . . . as shown in FIG. 5 in its memory locations addressed "000", "001", "010", . . . , respectively. These addresses correspond to the integer parts of the addresses shown in FIG. 5.

Figure 3:
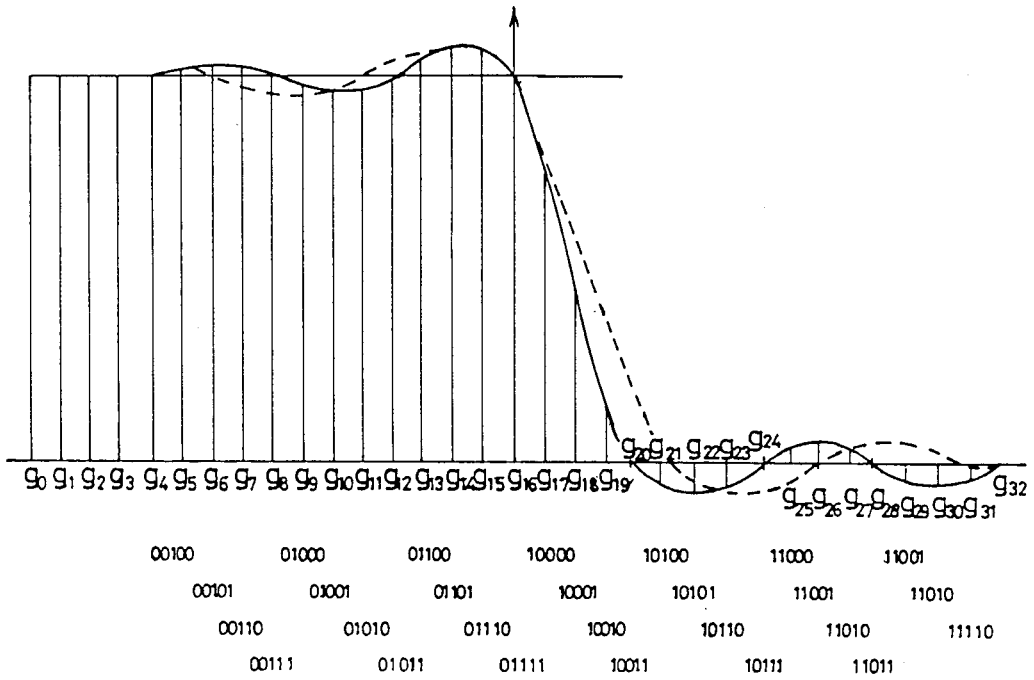
FIG. 3 is a diagram representing values stored in interpolation memories 14*a* and 14*b* of the embodiment.
Figure 4:
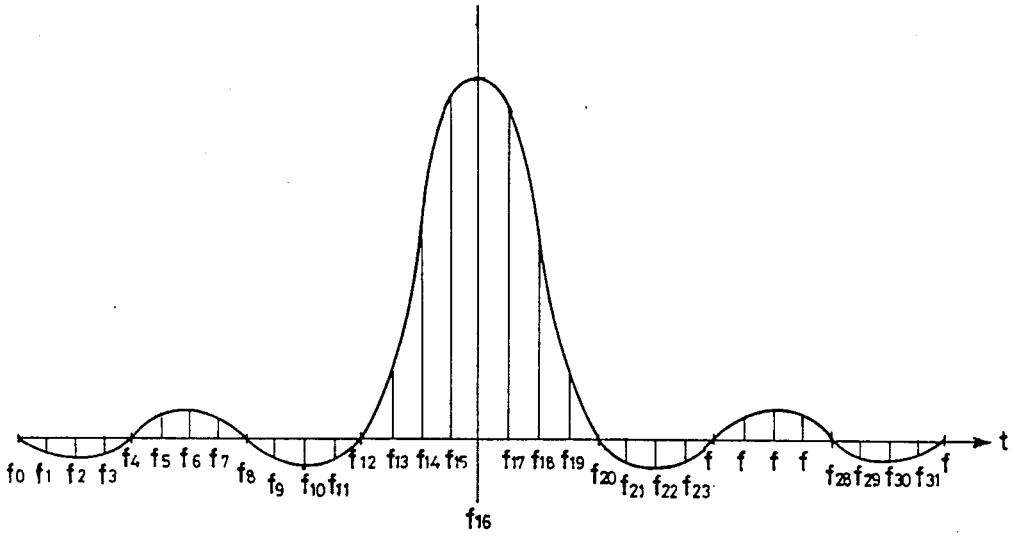
FIG. 4 is a diagram representing impulse response and its sample values of a low-pass filter used in the embodiment.
Figure 7:
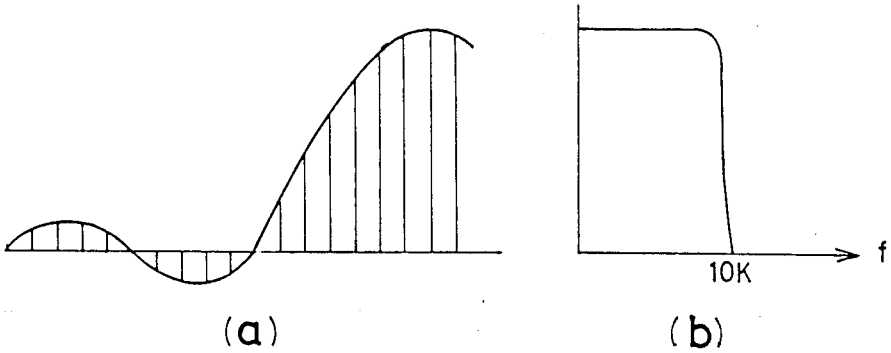
FIG. 7(*a*) is a diagram representing impulse response and its sample values of another low-pass filter used in the embodiment.
Figure 8:
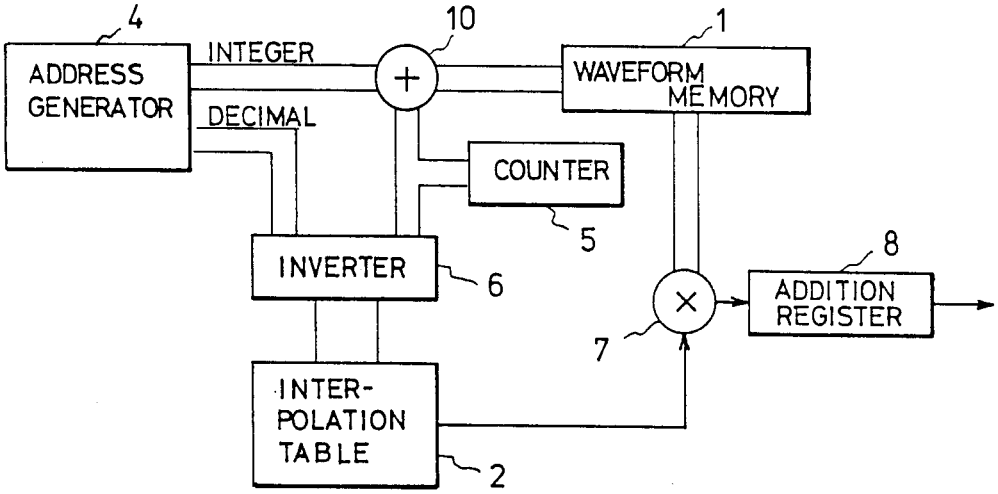
FIG. 8 PRIOR ART
FIG. 8 is a block diagram representing a prior art waveform generating device.
Figure 6:
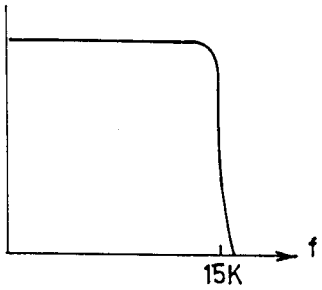
FIG. 6 is a diagram representing a frequency characteristic of the low-pass filter whose impulse response is shown in FIG. 4.
Figure 9:
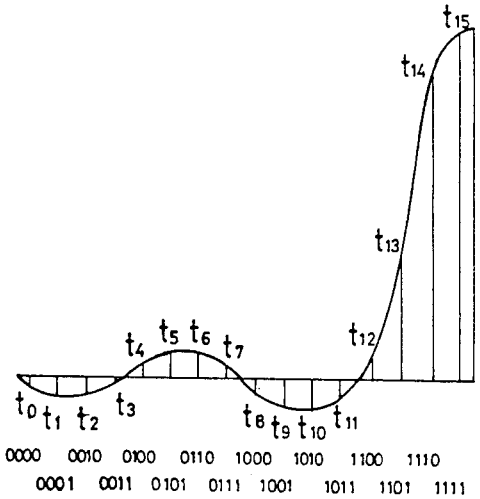
FIG. 9 is a diagram representing impulse response and its sample values of a low-pass filter used in this prior art waveform generating device.

The embodiment further includes three interpolation memories 14*a*, 14*b* and 14*c*. The interpolation memory 14*a* stores $g_4$ to $g_{32}$ of the integrated values of impulse response shown in FIG. 4 (or shown in FIG. 3 by a solid curve) of a low-pass filter for interpolation only (for example, having cut-off frequency of 15 KHz as shown in FIG. 6 when the waveform sampling frequency is 30 KHz) in its memory locations addressed "00100", "00101", . . . , respectively, in this order. The interpolation memory 14*b* stores, in similar fashion to the interpolation memory 14*a*, $g_4$ to $g_{32}$ of the integrated values of impulse response (as shown in FIG. 3 by a dashed curve) of a low-pass filter whose cut-off frequency is selected lower than that of FIG. 6, for example, as 10 KHz as shown in FIG. 7(*b*). FIG. 7(*a*) shows impulse response of the low-pass filter of FIG. 7(*b*) to which a suitable window is applied as in the case of the impulse response of FIG. 4. The interpolation memory 14*c* stores, in similar fashion to the interpolation memory 14*a*, $g_4$ to $g_{32}$ of the integrated values of impulse response (which is also applied with a suitable window) of a low-pass filter having cut-off frequency of 15 KHz and frequency characteristic (not shown) whose high frequency range is suppressed slightly. These interpolation memories 14*a*, 14*b* and 14*c* store nothing in their memory locations addressed "00000" to "00011". The integrated values $g_0$ to $g_3$ of each impulse response are not stored since they are all one (1) corresponding to the first term of equation (3). However, they do not become exactly one in the low-pass filter of FIG. 7(*b*), but the sound quality will not be affected by the error of this order. The three most significant bits of the addresses of interpolation memories 14*a*, 14*b* and 14*c* are specified as the integer part and the two least significant bits of them are specified as the decimal part.

One of these interpolation memories 14*a*, 14*b* and 14*c* is selected by a control circuit 16. The control circuit 16 is arranged, for example, so as to select the interpolation memories 14*a*, 14*b* and 14*c*, respectively, in response to high, medium and low stroke strength of a keyboard (not shown). While a device for detecting the stroke strength is required for this selection, it will not be described further since it is known by those skilled in the art.

The addresses used for reading the differences out of the waveform memory 12 are obtained by summing the count values of counters 18 and 20 in an adder 22. The counter 20 serves to specify the addresses for accessing the waveform memory, which may be of several ten bits when the waveform is stored from its leading edge to trailing edge. It is now assumed that the number of bits is three (3). The differences read out are supplied to an accumulator 24 and a multiplier 26.

The decimal part of the addresses for reading the integrated values of impulse response from one of the interpolation memories 14*a*, 14*b* and 14*c*, which is selected by the control circuit 16 is obtained by inverting the output of an address accumulator 28 in an invertor 30 and the integer part of each address is obtained from the output of counter 18.

32 denotes an increment register which is composed of an integer section 32*a* and a decimal section 32*b* and is provided with increment values from a frequency information memory 34. The frequency information memory 34 stores various increment values corresponding respectively to various pitches. The increment value to be supplied from the frequency information memory 34 to the increment register 32 is specified by a keyboard circuit 36. The keyboard circuit 36 responds to stroke of any key of a keyboard section having keys corresponding to respective pitches to deliver an information corresponding to that key; and the frequency information memory 34 responds thereto to deliver an increment value corresponding to the pitch of actuated key. For example, when the pitch of the waveform of FIG. 5 is 800 Hz and the pitch of the waveform to be restored is 600 Hz, the amplitudes $P_0$ to $P_8$ of FIG. 5 are needed and their addresses are "00011", "00110", "01001", . . . whose increment is "00011". The three least significant bits of this increment is stored in the increment register 32. More particularly, "11" is stored in the decimal section 32*b* of register 32 and "0" is stored in the integer section 32*a*. The reason why the integer section 32*a* has only one bit is that the pitch of waveform to be restored need not be made twice or more times the stored waveform pitch which is 800 Hz in this example, since the pitch of 1600 Hz or more would result in extreme change in the sound quality.

Figure 2:
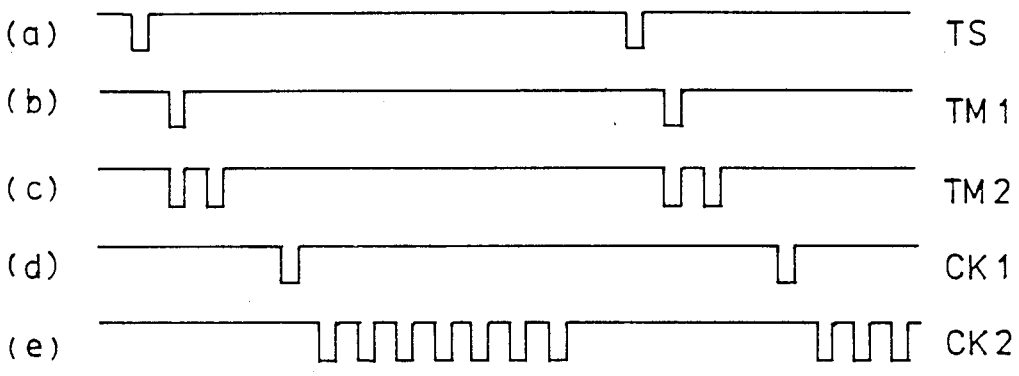

This embodiment includes further a multiplexer 38. The multiplexer 38 serves to provide the counter 20 with a signal TM1 appearing with some delay after a signal TS as shown in FIGS. 2(*a*) and (*b*) and described later, when "1" is stored in the integer section 32*a* of increment register 32 or when a carry signal is received from address accumulator 28, and with a signal TM2 having a first pulse coincident with the signal TM1 and a succeeding second pulse as shown in FIG. 2(*c*), when "1" is stored in the integer section 32*a* of increment register 32*a* and also a carry signal is received from address accumulator 28. The multiplexer 38 may be composed of an integrated circuit of type SN74 LS151 sold by Texas Instruments Inc. having eight input terminals 0, 1, . . . 7 and three bit data selection terminals A, B and C by supplying signal TM1 to the input terminals 1 and 2 and signal TM2 to the input terminal 3 and connecting the integer section 32*a* to terminal A, the carry signal to terminal B and "0" to terminal C, respectively.

The address accumulator 28 serves to accumulate the content of decimal section 32*b* of increment register 32 in response to every reception of signal TS having frequency equal to the sampling frequency as shown in FIG. 2(*a*) and deliver the accumulated value. The accumulator 24 responds to signal TM1 or TM2 read out of multiplexer 38 to accumulate the difference value currently read out of waveform memory 12 and, also, responds to first clock pulses CK1 appearing with some delay with respect to signal TM2 as shown in FIG. 2(*d*) to deliver the current content. The counter 18 counts seven second clock pulses CK2 following every first clock pulse CK1 as shown in FIG. 2(*e*). The resultant product from multiplier 26 is supplied through a three state buffer 52 to another accumulator 50 which is supplied also with the content of accumulator 24. The accumulator 50 responds to first and second clock pulses CK1 and CK2 applied through an OR circuit 54 and also responds to signal TS to deliver the accumulated content and then to be reset. The counter 18 is also reset by signal TS. The first clock pulses CK1 are supplied also through an invertor 56 to buffer 52 to inhibit delivery of the product from multiplier 26 to accumulator 50. In other words, the product from multiplier 26 is not supplied to accumulator 50 when the content of accumulator 24 is supplied to accumulator 50.

Now, the operation of this embodiment will be described below. Assume that the interpolation memory 14*a* has been selected by control circuit 16 and the increment register 32 stores "0" and "11" in its integer and decimal sections 32*a* and 32*b*, respectively, and that the previously interpolated value of amplitude is $P_3$ having address "01100", its value for interpolation is stored in accumulator 50 and $Y_0$ is stored in accumulator 24. Then, the content of counter 20 is "000" and the content of accumulator 28 is "00". What is interpolated next in this state is $P_4$.

Upon reception of signal TS, the accumulator 50 outputs the previous value for interpolation and is then reset and the counter 18 is also reset. Then, the content of address accumulator 28 becomes "11". At this time, neither signal TM1 nor TM2 is delivered from multiplexer 38, since no carry signal is supplied by address accumulator 28 and the content of the integer section 32*a* of increment address register 32 is "0". Accordingly, the count of counter 20 is "000" and the count of counter 18 is also "000". Both counts are summed in adder 22 and $Y_0$ is read out from the address "000" of waveform memory 12 and supplied to accumulator 24. However, no accumulation is effected in accumulator 24 since neither signal TM1 nor TM2 is provided from multiplexer 38, and the content of accumulator 24 is left as $Y_0$. At the same time, the interpolation memory 14*a* is provided as the decimal part with the content "00" of address accumulator 28 inverted by invertor 30 and as the integer part with the count "000" of counter 18 and the content of the resultant address "00011" (nothing is stored in this address) is read out and multiplied in multiplier 26 whose output is supplied through buffer 52 to accumulator 50. However, no accumulation is effected in accumulator 50 since no accumulation command is applied from OR circuit 54.

When clock pulse CK1 appears in the meantime, $Y_0$ is delivered from accumulator 24 to accumulator 50 and accumulated therein. As described previously, the product from multiplier 26 is inhibited from application to accumulator 50 by buffer 52.

In response to the first one of second clock pulses CK2 (illustrated in FIG. 2(*e*)), the count of counter 18 becomes "001" which is summed in adder 22 with the count "000" of counter 20 and the output of adder 22 is applied to waveform memory 12. Thus, $d_1$ is read out from the address "001" of waveform memory 12 and supplied to multiplier 26.

At the same time, the interpolation memory 14*a* is provided as the integer part of its address with the count "001" of counter 18 and as the decimal part thereof with the content "11" of address accumulator 28 inverted by invertor 30 into output "00" and, therefore, $g_5$ is read out from the address "00100" of interpolation memory 14*a*. $d_1$ and $g_5$ which were thus read out are multiplied in multiplier 26 and the resultant product is supplied through buffer 52 to accumulator 50 for accumulation.

In similar fashion, thereafter, every with count of counter 18, $g_{13}$, $g_{17}$, . . . $g_{29}$ are read out sequentially from those addresses of interpolation memory 14*a* having "00" as their decimal part and $d_3$, $d_4$, . . . $d_7$ are read out from those addresses of waveform memory 12 having "00" as their decimal part. Then, the multiplier 26 calculates sequentially the products $d_3g_{13}$, $d_4g_{17}$, . . . $d_7g_{29}$ which are supplied to accumulator 50 for accumulation. When the accumulator 50 receives another signal TS, it delivers the accumulated content and is then reset, and the counter 18 is also reset.

On the other hand, the address accumulator 28 responds to signal TS to accumulate the content "11" of increment address register 32*b* to its content "11" into "110" and supplies a carry signal to multiplexer 38. Thus, the counter 20 is incremented into "001" and, therefore, $d_1$ is read out of waveform memory 12 and supplied to accumulator 24 for accumulation. Accordingly, the content of accumulator 24 becomes $Y_1$. Thereafter, $d_2$, $d_3$, . . . and $g_6$, $g_{10}$, $g_{14}$, . . . corresponding to $P_5$ are read out similarly in accordance with the count of counter 18 and processed in similar manner as described above.

If the increment in increment address register 32 has "1" in its integer section 32*a* and "11" in its decimal section 32*b* and the previously interpolated value is $P_x$ whose address is "10011", the content of accumulator 24 is $Y_1$. If the address register 28 receives signal TS in this state, its content becomes "110" and it provides a carry signal. The multiplexer 38 responds to the content "1" of integer section 32*a* and the carry signal to provide signal TM2 to counter 20, thereby changing its count from "001" through "010" into "011". Accordingly, the waveform memory 12 provides $d_2$ of its address "010" and $d_3$ of its address "011" to accumulator 24 to change its content into $Y_3$. Then, the interpolation is applied to $P_y$ having an address incremented by "111" from that of $P_x$ in the same manner as above.

As described above, it is possible to simplify the circuit configuration used for convolution operation by storing integrated values of impulse response in the interpolation memories in accordance with this invention, even if the differences of respective sample values are stored in the waveform memory.

Moreover, the following benefit is obtained by providing a plurality of interpolation memories for storing integrated values of impulse response of low-pass filters having different characteristics and selectively using them as in the case of the illustrated embodiment. A sound approximate to natural musical sound is obtained, for example, by using an interpolation memory corresponding to a specific filter used exclusively for interpolation when the keyboard stroke strength is large, another interpolation memory corresponding to a low-pass filter having cut-off frequency lower than that of the above specific filter when the stroke strength is medium and a further interpolation memory corresponding to a filter whose high band is suppressed relative to the specific filter when the stroke strength is small.

It is possible to prevent appearance of aliasing by switching the interpolation memories in accordance with the pitch of waveform to be reproduced. Particularly, when the waveform is reproduced at a higher pitch than that of the waveform stored in the waveform memory, aliasing may appear since a natural musical sound includes harmonics of higher order. This is due to a fact that the sampling frequency becomes substantially low since reproduction is effected at a pitch higher than the original pitch, notwithstanding that the sampling frequency must be higher than the maximum frequency of a sound to be sampled. Accordingly, aliasing can be avoided by using an interpolation memory corresponding to a low-pass filter having a cut-off frequency which is a half of the sampling frequency in case of reproduction at a pitch lower than that of the original waveform, and switching to another interpolation memory corresponding to a low-pass filter having cut-off frequency lower than that of the above low-pass filter.

More specifically, in the above embodiment, the interpolation memory 14*a* may be used in case of reducing the pitch relative to the original waveform, the interpolation memory 14*b* may be used in case of increasing the pitch up to 1.5 times that of the original waveform and another interpolation memory (not shown) storing integrated values of impulse response of a low-pass filter having cut-off frequency of 7.5 KHz may be used in case of increasing the pitch up to twice that of the original waveform.

What is claimed is:

1. A waveform generating device for electronic musical equipment, comprising:

means for generating addresses consisting of an integral part and a fractional part each;

waveform memory means for storing differences between adjoining samples of amplitude form a waveform for subsequent generation thereof;

interpolation memory means for storing coefficients $g_{i+mj}$ which are given by an equation $$g_{i+mj} = \sum_{k=j}^{n-1} f_{i+mk}$$

where $i=0, 1, 2, \ldots m-1$, and $j=1, 2, \ldots n-1$, and where $f_{i+mk}$ denotes specific ones of a series of amplitude values $f_L(L=0, 1, 2, \ldots mn-1)$ sampled from an impulse response characteristic of a low-pass interpolation filter at a frequency equal to "m" times a sampling frequency of said waveform, and "n" denotes the number of interpolation points;

means for effecting a convolution operation using said differences read out in correspondence to the integral parts of said addresses and said coefficients read out in correspondence to the fractional parts of said adresses;

means for accumulating said differences in the waveform; and means for summing a value resulting from said accumulating and a resultant of said convolution operation to obtain the amplitude of said waveform.

2. A waveform generating means, as set forth in claim 1, wherein said means for effecting a convolution operation includes:

means for sequentially reading $(n-1)$ waveform differences and corresponding coefficients;

means for multiplying said differences and said coefficients; and means for accumulating the resultant products thereof.

* * * * *